US006142804A

United States Patent [19]

Peloza et al.

[11] Patent Number: 6,142,804

[45] Date of Patent: Nov. 7, 2000

[54] ELECTRICAL SWITCHING CONNECTOR

[75] Inventors: Kirk B. Peloza, Naperville, Ill.; John M. Horgan, Limerick, Ireland

[73] Assignee: Molex Incorporated, Lisle, Ill.

[21] Appl. No.: 09/264,926

[22] Filed: Mar. 9, 1999

[51] Int. Cl.[7] ..... H01R 29/00

[52] U.S. Cl. ..... 439/188

[58] Field of Search ..... 439/108, 188; 200/51.1, 51.09, 51.05

[56] References Cited

U.S. PATENT DOCUMENTS

| | | | |
|---|---|---|---|
| 4,708,414 | 11/1987 | Lam | 439/394 |
| 4,946,392 | 8/1990 | Kobler et al. | 439/63 |
| 5,062,809 | 11/1991 | Sakamoto et al. | 439/581 |
| 5,083,934 | 1/1992 | Kawaguchi | 439/394 |
| 5,154,632 | 10/1992 | Ijiri | 439/394 |
| 5,267,868 | 12/1993 | Wolff, Jr. | 439/95 |
| 5,304,069 | 4/1994 | Brunker et al. | 439/108 |
| 5,453,019 | 9/1995 | Garver et al. | 439/188 |
| 5,482,475 | 1/1996 | Kawaguchi | 439/394 |
| 5,944,546 | 8/1999 | Miyake et al. | 439/188 |
| 6,011,698 | 1/2000 | Buehler | 361/799 |

FOREIGN PATENT DOCUMENTS 6-251832 2/1993 Japan .

*Primary Examiner*—Khiem Nguyen
*Assistant Examiner*—Brian S. Webb
*Attorney, Agent, or Firm*—Stephen Z. Weiss

[57] ABSTRACT

An electrical switching connector includes a dielectric housing defining a receptacle. A first switch terminal is mounted on the housing and includes a contact portion at the receptacle. A second switch terminal is mounted on the housing and includes a flexible contact portion projecting into the receptacle and engageable with the contact portion of the first switch terminal. Therefore, a terminal of a complementary mating connector can be inserted into the receptacle in engagement with the flexible contact portion and move that contact portion out of engagement with the contact portion of the first switch terminal. A pair of ground terminals are mounted on the housing and each ground terminal is juxtaposed alongside one of the switch terminals. In the exemplary embodiment of invention, at least portions of at least one of the switch terminals and one of the ground terminals are overmolded by the housing.

16 Claims, 5 Drawing Sheets

ELECTRICAL SWITCHING CONNECTOR

FIELD OF THE INVENTION

This invention generally relates to the art of electrical connectors and, particularly, to an electrical switching connector, such as a radio frequency transceiver connector which might be mounted on a printed circuit board.

BACKGROUND OF THE INVENTION

Radio frequency electrical connectors are used in a wide variety of applications. Such connectors are used in mobile telephones, global positioning systems and the like. Basically, such a connector is a microwave connector.

One example of such connectors is an electrical switching connector used in a transceiver of such devices which requires an antenna, such as a mobile telephone. The transceiver may be normally connected to an internal antenna, and switching terminals are provided for connecting the unit to an external antenna. The switching terminals are normally closed, and a terminal from a coaxial cable opens the normally closed terminals to disconnect the transceiver from the internal antenna and connect the transceiver to the external antenna. With the system being a radio frequency system, ground terminals also are employed in conjunction with the switching terminals.

In designing electrical connectors of the character described above, there is a tendency to make the connectors unduly complicated which results in the connectors being unnecessarily expensive. The present invention is directed to providing such a connector in the form of a radio frequency receptacle which is extremely simple and, consequently, quite inexpensive.

SUMMARY OF THE INVENTION

An object, therefore, of the invention is to provide a new and improved electrical switching connector of the character described.

Another object of the invention is to provide a radio frequency switching connector for mounting on a printed circuit board.

In the exemplary embodiment of the invention, the connector includes a molded dielectric housing defining a receptacle. A first switch terminal is at least partially overmolded by the housing and includes a tail portion projecting from the housing for connection to a printed circuit board and a contact portion at the receptacle. A second switch terminal is mounted in the housing and includes a tail portion projecting from the housing for connection to the printed circuit board and a flexible contact portion projecting into the receptacle and engageable with the contact portion of the first switch terminal. Therefore, a terminal of a complementary mating connector can be inserted into the receptacle and in engagement with the flexible contact portion of the second switch terminal to move the flexible contact portion out of engagement with the contact portion of the first switch terminal. A pair of ground terminals are at least partially overmolded by the housing and include tail portions projecting from the housing for connection to the printed circuit board. Each ground terminal is juxtaposed alongside one of the switch terminals.

As disclosed herein, all of the terminals are stamped and formed of sheet metal material. All of the tail portions of the terminals are generally coplanar for connection to a surface of the printed circuit board. The contact portion of the first switch terminal and body portions of the pair of ground terminals also are coplanar in a plane offset from the plane of the tail portions of the terminals. At least a portion of the second switch terminal overlaps at least a portion of one of the ground terminals to define a capacitor therebetween.

The ground terminals are shown herein as being integrally joined. Specifically, the pair of ground terminals form the legs of a generally U-shaped configuration, with ends of the legs being integrally joined by a cross portion of the U-shaped configuration which surrounds three sides of the contact portion of the first switch terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
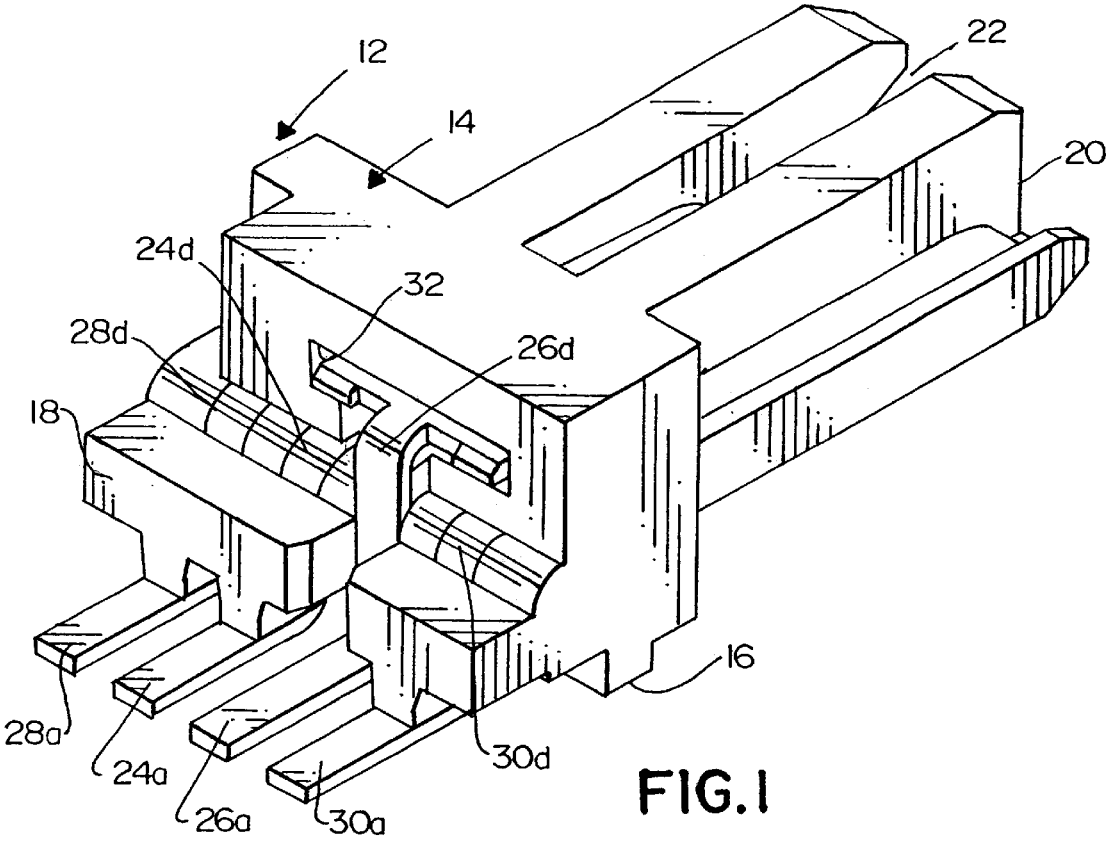
FIG. 1 is a perspective view of the electrical switching connector of the invention, looking toward the rear terminating end thereof.
Figure 2:
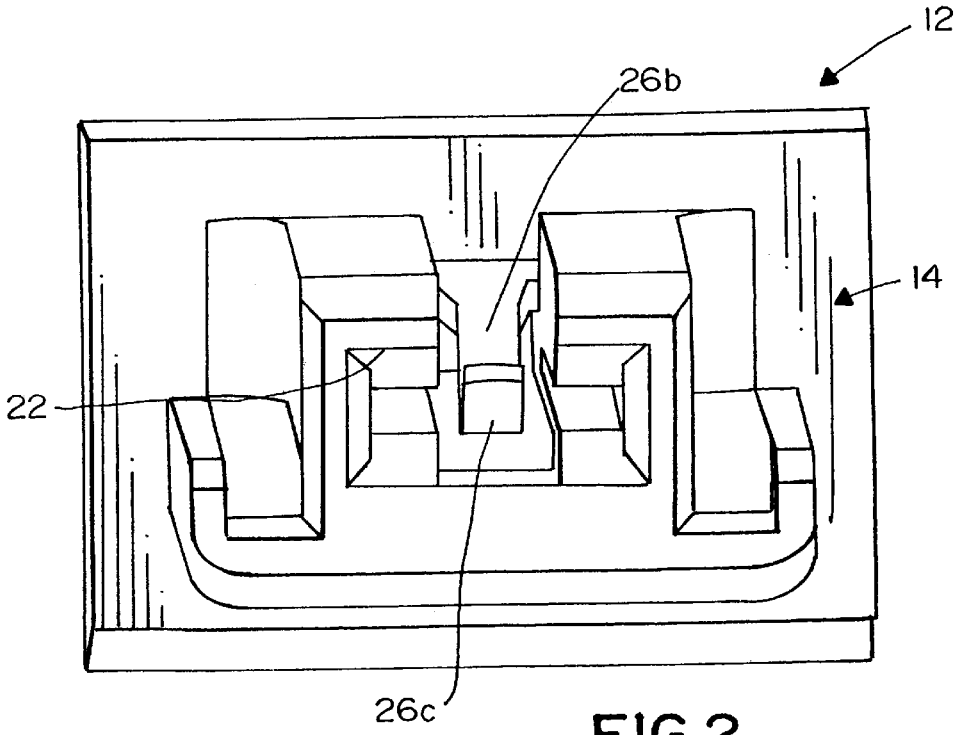
FIG. 2 is a view looking toward the front receptacle end of the connector.

Referring to the drawings in greater detail, and first to FIGS. 1 and 2, the invention is embodied in an electrical switching connector, generally designated 12, which includes a one-piece housing, generally designated 14. The housing is unitarily molded of dielectric material such as plastic or the like. The housing has a bottom mounting surface 16 for mounting the connector on the surface of a printed circuit board (not shown). The housing has a rear terminating end 18 (FIG. 1) and a front receptacle end 20 defining a receptacle 22 (FIG. 2) which receives at least a terminal blade of a complementary mating connector, such as for a coaxial cable coupled to an external antenna.

Figure 3:
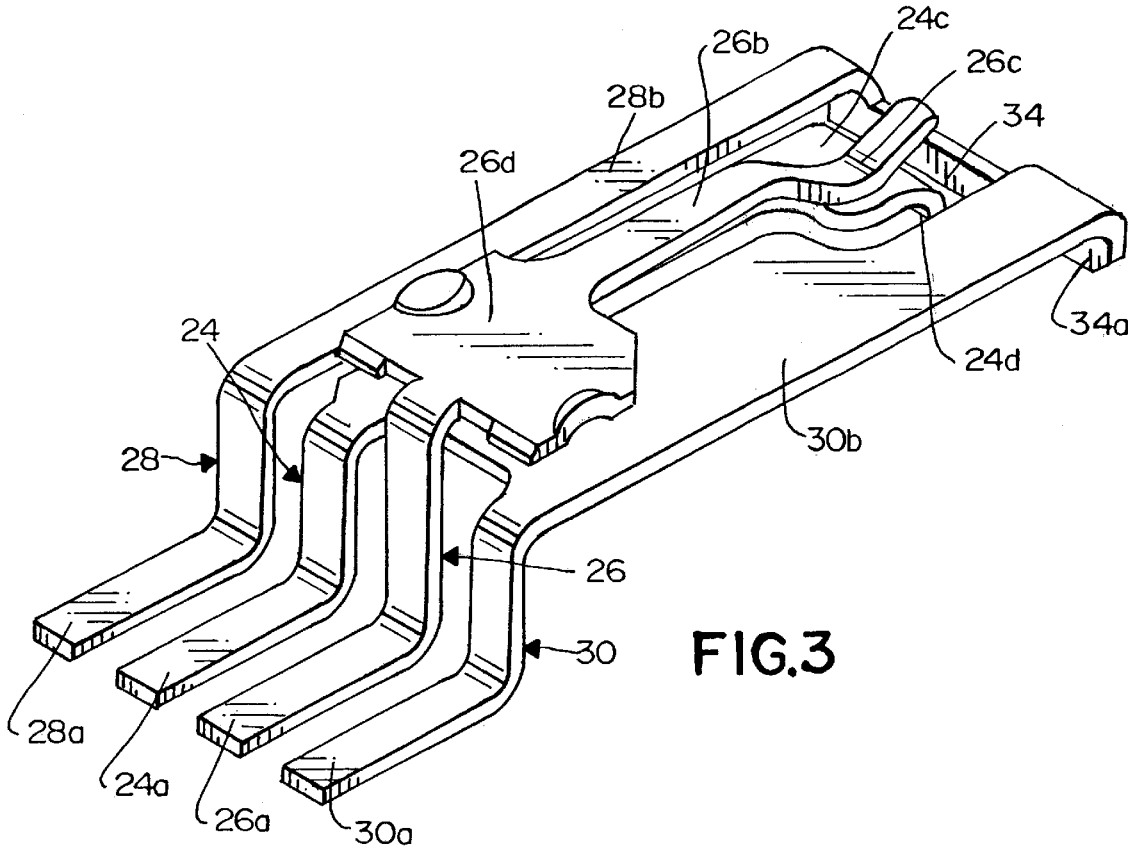
FIG. 3 is a perspective view of the terminals of the connector.
Figure 4:
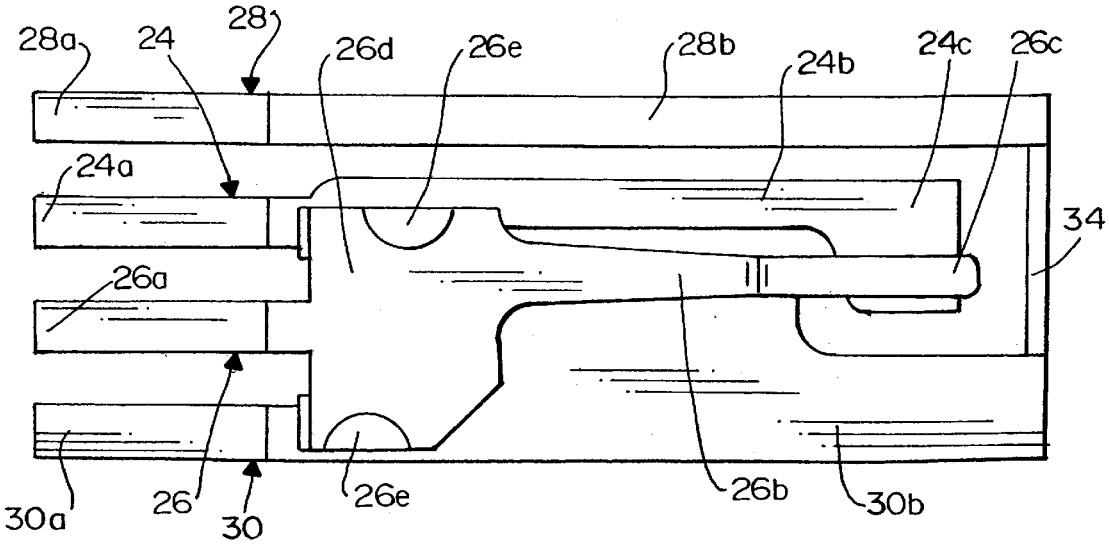
FIG. 4 is a top plan view of the terminals of the connector.

Referring to FIGS. 3 and 4 in conjunction with FIGS. 1 and 2, switching connector 12 includes a first switch terminal, generally designated 24; a second switch terminal, generally designated 26; a first ground terminal, generally designated 28; and a second ground terminal, generally designated 30. All of the terminals are stamped and formed of conductive sheet metal material. All of the terminals 24–30 have coplanar tail portions 24*a*–30*a*, respectively, for connection to appropriate power and ground circuit traces on the printed circuit board, as by soldering.

First switch terminal 24 is the "switched" terminal of the connector and includes an elongated body portion 24*b* extending through housing 14 and including a widened distal end 24*c* defining a contact portion located at receptacle 22 of the housing.

Ground terminals 28 and 30 also have elongated body portions 28*b* and 30*b*, respectively, extending forwardly in the housing on opposite sides of the body portion 24*b* of switch terminal 24. Body portion 30b of ground terminal 30 is wider than body portion 28*b* of ground terminal 28 and includes a cut-out area 30*c* for accommodating the widened contact portion 24*c* of switch terminal 24. All of the body portions 24*b*, 28*b* and 30*b* of the respective switch and ground terminals are generally coplanar.

Second switch terminal 26 is a "common" or power terminal of the connector and has an elongated body portion 26*b* which is elevated in a plane above the plane of the body portions of the other terminals. The body portion of the second switch terminal is flexible and has a downwardly projecting, bowed contact portion 26*c* which is normally in engagement with contact portion 24*c* of first switch terminal 24 to provide a normally closed switch for connector 12.

As best seen in FIG. 1, transition portions 24*d*, 28*d* and 30*d* of switch terminal 24 and ground terminals 28 and 30, respectively, along with at least portions of the body portions of those terminals, are overmolded by molded plastic housing 14 to rigidify the terminals and maintain the terminals in precise position and spacing. This can be done easily in a molding die. On the other hand, second switch terminal 26 is inserted into a slot 32 at the rear of the housing so that body portion 26*b* of the terminal is free to flex relative to body portion 24*b* of the first switch terminal 24. As best seen in FIGS. 3 and 4, the second switch terminal has an enlarged plate portion 26*d* which is insertable into slot 32 of the housing. A pair of rounded locking bosses 26*e* provide an interference fit within slot 32 to hold switch terminal 26 in the housing.

As best seen in FIGS. 3 and 4, body portion 28*b* and 30*b* of ground terminals 28 and 30 respectively, form the legs of a generally U-shaped configuration, with the ends of the legs being integrally joined by a cross portion 34 of the U-shaped configuration. Therefore, the unitary U-shaped ground terminal structure surrounds body portion 24*b* and contact portion 24*c* of first switch terminal 24. Finally, as best seen in FIG. 3, in cross portion 34 of the ground terminal structure has a downwardly turned lip 34*a*, and widened contact portion 24*c* of first switch contact 24 also has a downwardly turned lip 24*d*.

Figure 5:
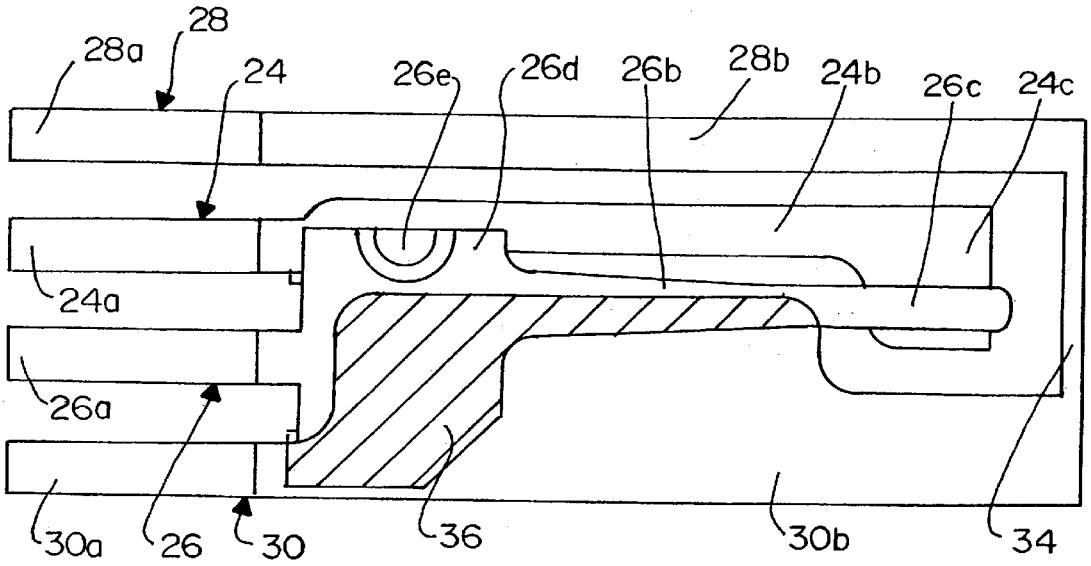
FIG. 5 is a view similar to that of FIG. 4, highlighting the overlapping area between the power terminal and one of the ground terminals.

FIG. 5 is a duplicate of FIG. 4 and simply highlights an area 36 whereat plate portion 26*d* of second switch terminal 26 overlaps body portion 30*b* of ground terminal 30. This overlapping area provides an increase in the capacitor area between those terminals which, in turn, lowers the characteristic impedance of the connector.

Figure 6:
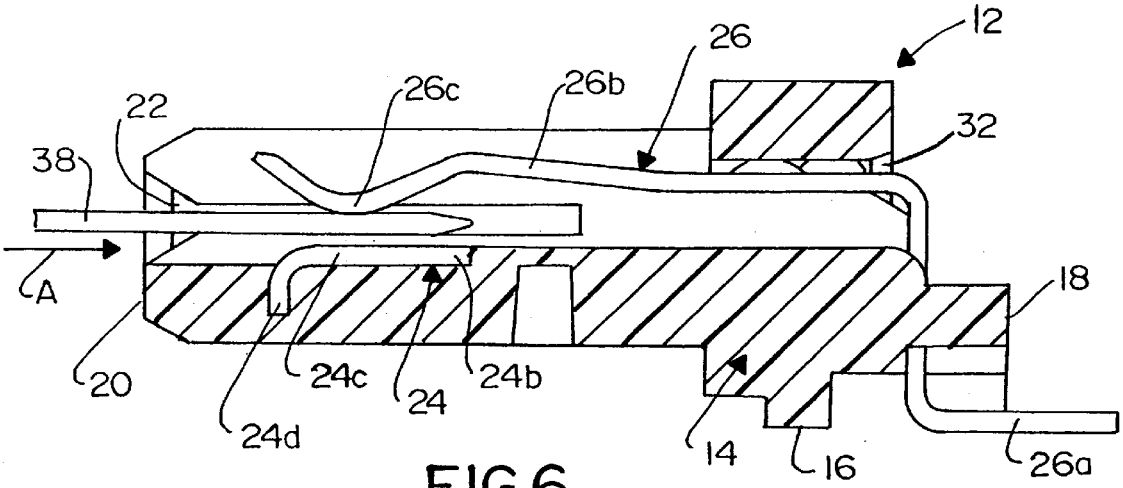
FIG. 6 is a view showing a contact of a complementary mating connector lifting the switched terminal off of the power terminal.
Figure 7:
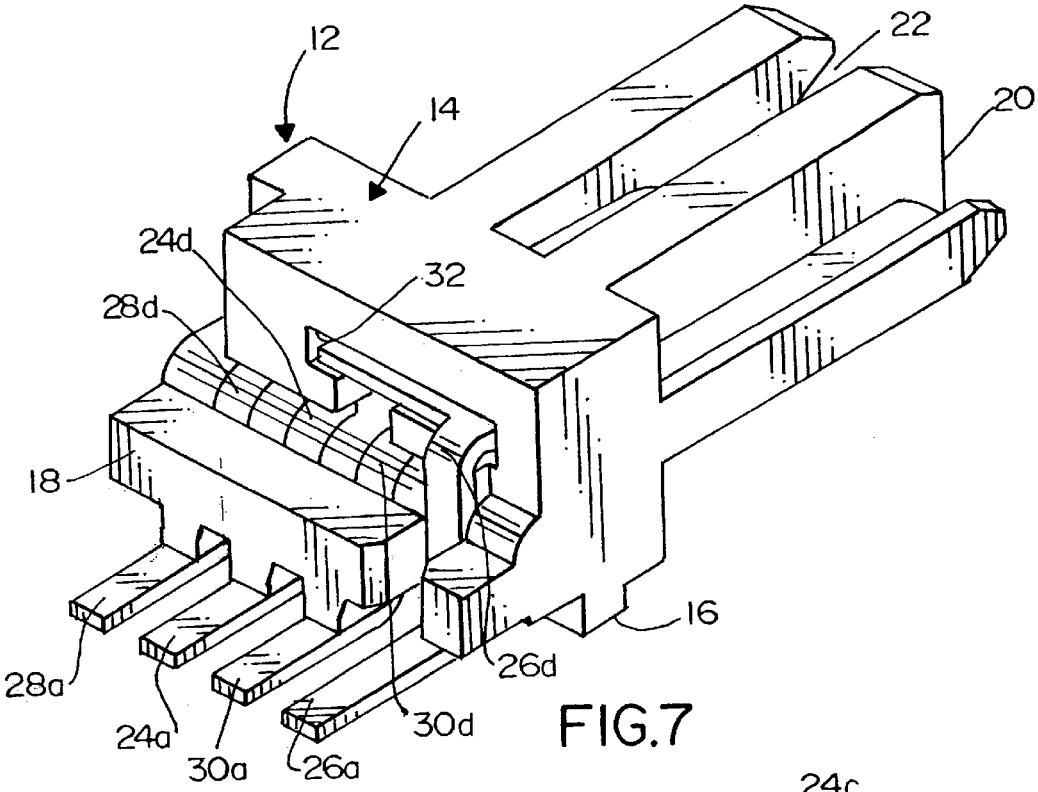
FIG. 7 is a view similar to that of FIG. 1, but showing an alternate configuration for the tail portions of the terminals.
Figure 8:
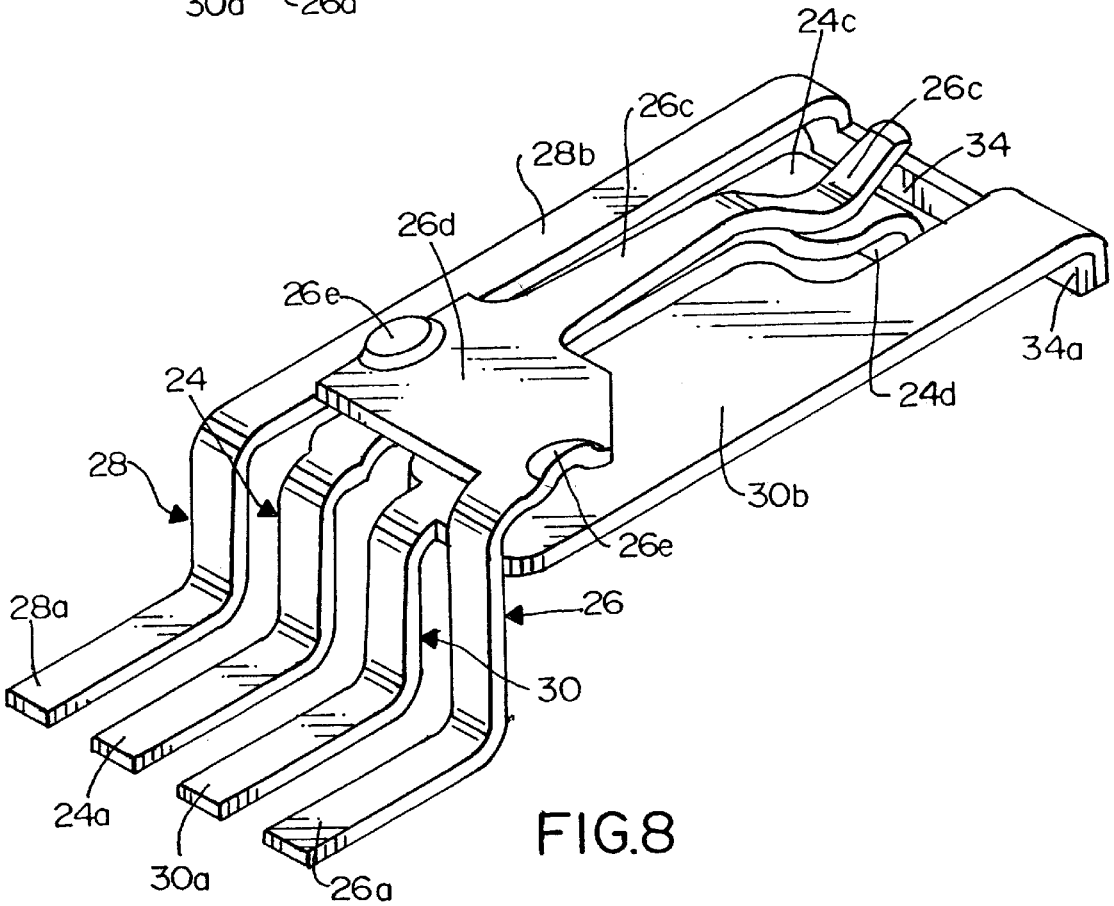
FIG. 8 is a perspective view of the terminals of the connector in FIG. 7.
Figure 9:
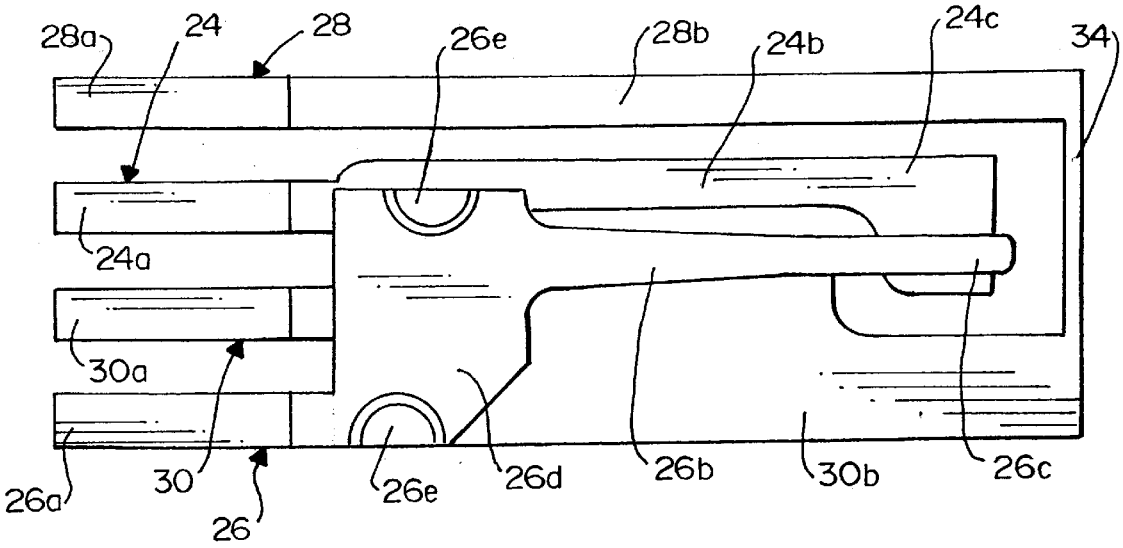
FIG. 9 is a top plan view of the terminals of FIG. 8.

FIG. 6 shows a terminal blade 38 of a complementary mating connector inserted into connector 12 and into engagement with contact portion 26*c* of second switch terminal 26. This lifts contact portion 26*c* off of contact portion 24*c* of first switch terminal 24 and, thereby, opens the switch therebetween. In an actual application, switching connector 12 may be a transceiver connector in a mobile telephone unit, for instance. The unit will have an internal antenna which is connected to switch terminal 24 and which is normally coupled in circuit by the normally closed switch terminals 24 and 26. Terminal blade 38 (FIG. 6) may be from a coaxial cable coupled to an external antenna. Therefore, when blade 38 engages contact portion 26*c* of switch terminal 26 to "open" the switch of connector 12, the engagement of blade 38 with second switch terminal 26 now disengages the connector from the internal antenna and couples the connector to the external or outside antenna.

FIGS. 7–10 show an alternate embodiment of the invention and like numerals have been applied in FIGS. 7–10 corresponding to like components described above in relation to FIGS. 1–6. The main difference between the embodiment of FIGS. 7–10 and the embodiment of FIGS. 1–6 is the position of tail portions 26*a* and 30*a* of second switch terminal 26 and second ground terminal 30. Basically, the tails of the terminals define input leads to the connector. These different embodiments show that the input leads can be easily interchanged in position to allow different "hook-ups" on the printed circuit board. This is difficult if not impossible with most prior art radio frequency receptacles because of the manner in which the shields of those receptacles are designed.

Figure 10:
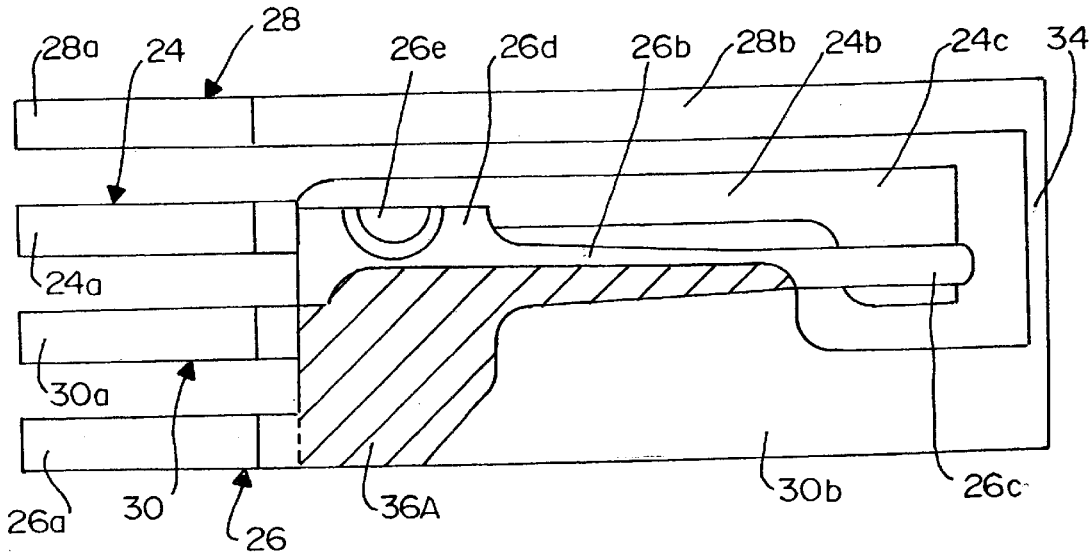
FIG. 10 is a view similar to that of FIG. 9, highlighting the overlapping area between the power terminal and one of the ground terminals.

FIG. 10 also shows a difference between the embodiment of FIGS. 7–10 and the embodiment of FIGS. 1–5. Specifically, an overlapping area 36A between second switch terminal 26 and second ground terminal 30 as highlighted in FIG. 10 is slightly larger than the overlapping area 36 in FIG. 5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical switching connector for mounting on a printed circuit board, comprising:

a molded dielectric housing defining a receptacle;

a first switch terminal at least partially overmolded by the housing and including a tail portion projecting from the housing for connection to the printed circuit board and a contact portion at said receptacle;

a second switch terminal mounted on the housing and including a tail portion projecting from the housing for connection to the printed circuit board and a flexible contact portion projecting into the receptacle and engageable with the contact portion of the first switch terminal, whereby a terminal of a complementary mating connector can be inserted into the receptacle in engagement with the flexible contact portion of the second switch terminal to move said flexible contact portion out of engagement with the contact portion of the first switch terminal; and a pair of ground terminals at least partially overmolded by the housing and including tail portions projecting from the housing for connection to the printed circuit board, each ground terminal being juxtaposed alongside one of the switch terminals, the contact portion of said first switch terminal and body portions of said pair of ground terminals being coplanar.

2. The electrical switching connector of claim 1 wherein the tail portions of the said first and second switch terminals and said pair of ground terminals are coplanar.

3. The electrical switching connector of claim 1 wherein said first switch terminal and said pair of ground terminals are stamped and formed of sheet metal material.

4. The electrical switching connector of claim 3 wherein the tail portions of the said first and second switch terminals and said pair of ground terminals are coplanar in a plane offset from the plane of said contact portion of the first switch terminal and the body portions of the pair of ground terminals.

5. The electrical switching connector of claim 1 wherein said pair of ground terminals are integrally joined.

6. The electrical switching connector of claim 5 wherein said pair of ground terminals form the legs of a generally U-shaped configuration with ends of the legs being integrally joined by a cross portion of the U-shaped configuration which surrounds three sides of the contact portion of the first switch terminal.

7. The electrical switching connector of claim 1 wherein at least a portion of said second switch terminal overlaps at least a portion of one of said ground terminals.

8. An electrical switching connector, comprising:

a dielectric housing defining a receptacle;

a first switch terminal mounted on the housing and including a contact portion at said receptacle;

a second switch terminal mounted on the housing and including a flexible contact portion projecting into the receptacle and engageable with the contact portion of the first switch terminal, whereby a terminal of a complementary mating connector can be inserted into the receptacle in engagement with the flexible contact portion of the second switch terminal to move said flexible contact portion out of engagement with the contact portion of the first switch terminal;

a pair of ground terminals juxtaposed alongside one of the switch terminals, the contact portion of said first switch terminal and body portions of said pair of ground terminals being coplanar; and said second switch terminal and one of said ground terminals having overlapping capacitor plate portions.

9. The electrical switching connector of claim 8 wherein said first switch terminal and said pair of ground terminals are stamped and formed of sheet metal material.

10. The electrical switching connector of claim 8 wherein said first switch terminal and said pair of ground terminals are stamped and formed of sheet metal material.

11. The electrical switching connector of claim 8 wherein said pair of ground terminals are integrally joined.

12. The electrical switching connector of claim 11 wherein said pair of ground terminals form the legs of a generally U-shaped configuration with ends of the legs being integrally joined by a cross portion of the U-shaped configuration which surrounds three sides of the contact portion of the first switch terminal.

13. An electrical switching connector, comprising:

a dielectric housing defining a receptacle;

a first switch terminal mounted on the housing and including a contact portion at said receptacle;

a second switch terminal mounted on the housing and including a flexible contact portion projecting into the receptacle and engageable with the contact portion of the first switch terminal, whereby a terminal of a complementary mating connector can be inserted into the receptacle in engagement with the flexible contact portion of the second switch terminal to move said flexible contact portion out of engagement with the contact portion of the first switch terminal;

a pair of ground terminals juxtaposed alongside one of the switch terminals, the contact portion of said first switch terminal and body portions of said pair of ground terminals being coplanar; and said pair of ground terminals forming the legs of a generally U-shaped configuration with ends of the legs being integrally joined by a cross portion of the U-shaped configuration which surrounds three sides of the contact portion of the first switch terminal.

14. The electrical switching connector of claim 13 wherein said first switch terminal and said pair of ground terminals are stamped and formed of sheet metal material.

15. The electrical switching connector of claim 13 wherein said first switch terminal and said pair of ground terminals are stamped and formed of sheet metal material.

16. The electrical switching connector of claim 13 wherein at least a portion of said second switch terminal overlaps at least a portion of one of said ground terminals.

* * * * *